United States Patent [19]

Towner et al.

[11] Patent Number: 4,936,383

[45] Date of Patent: Jun. 26, 1990

[54] DOWNHOLE PUMP PULSATION DAMPENER

[75] Inventors: Geoffrey F. Towner, Dallas, Tex.; John E. T. Towner, Victorial Park, Australia

[73] Assignee: ICO-Texaust Joint Venture, Inc., Ft. Worth, Tex.

[21] Appl. No.: 339,935

[22] Filed: Apr. 18, 1989

Related U.S. Application Data

[63] Continuation of Ser. No. 184,936, Apr. 22, 1988, abandoned.

[51] Int. Cl.[5] ..... E21B 43/00

[52] U.S. Cl. ..... 166/68; 166/106; 417/540

[58] Field of Search ..... 166/68, 68.5, 105, 106, 166/107, 108, 109, 110; 417/540; 138/26

[56] References Cited

U.S. PATENT DOCUMENTS

| | | | |
|---|---|---|---|
| 1,235,112 | 7/1917 | Coberly . | |
| 1,292,778 | 1/1919 | Holmes . | |
| 1,576,606 | 3/1926 | Haskell . | |
| 2,215,558 | 9/1940 | Miller . | |
| 2,359,389 | 10/1944 | Saulsberry . | |
| 2,435,179 | 1/1948 | McGovney . | |
| 2,664,049 | 12/1953 | Coberly | 417/540 X |
| 2,712,831 | 7/1955 | Day | 138/26 |
| 2,734,462 | 2/1956 | Schaefer . | |
| 2,746,103 | 9/1956 | Mercier . | |
| 3,272,145 | 9/1966 | Towner . | |
| 3,370,544 | 2/1968 | Thorpe, Sr. | 417/540 X |
| 4,628,994 | 12/1986 | Towner et al. | 166/68 |

*Primary Examiner*—William P. Neuder

*Attorney, Agent, or Firm*—James E. Bradley

[57] ABSTRACT

A pulsation dampener for a downhole reciprocating pump system which is positioned at the lower end of the production tubing just above the barrel of the pump. The dampener has a perforated conduit on which an elastic sleeve is fitted to seal the perforations when in a relaxed position. A housing surrounds the sleeve and forms an annulus between the annulus and the housing which is precharged with gas.

12 Claims, 2 Drawing Sheets

DOWNHOLE PUMP PULSATION DAMPENER

This application is a continuation of application Ser. No. 184,936, filed Apr. 22, 1988, now abandoned.

DESCRIPTION

1. Technical Field

The present invention relates generally to a downhole pump pulsation dampener and in one of its preferred aspects to a pulsation dampener which is adapted to be positioned downhole in the production tubing of a well above a reciprocating pump to dampen the pressure surges and acceleration shocks in the fluid being pumped from the well.

2. Background Art

In the vast majority of wells wherein fluids are artificially lifted to the surface, some type of reciprocating, plunger pump is used which is positioned downhole in the well and is operated by a string of "sucker rods" which extend to the surface. The sucker rod string is reciprocated by a "pump jack" or the like to move the plunger up and down in the barrel of the pump to thereby force fluid upward through the production tubing but only on alternate strokes, e.g., each up-stroke of the plunger. While reciprocating pumps have proven extremely dependable for a great number of years, problems still exist in most downhole, reciprocating pump systems which are directly related to the pressure pulsations or "shocks" which are inherently present due to the alternating pump strokes. As is well known in the art, these pressure pulsations or shocks can be highly detrimental and, if unchecked, are likely to eventually cause damage to the pumping system and to substantially increased maintenance costs.

For example, the pressure pulsations and/or acceleration shocks in the pumped flow can create a severe "water-hammer" effect throughout the system thereby subjecting various components and piping in the systems to destructive impact and/or vibratory forces. This is due in part to the fact that the head of fluid in the tubing is at rest at the start of the up or pump stroke and must be accelerated as the plunger moves upward from its bottom dead center position. Therefore, at the start of each pump stroke, the sucker rods are subjected to the combined forces of (1) the weight of the fluid head; (2) the weight of the rods, themselves; and (3) the forces required to accelerate the fluid head and to overcome the frictional forces in the system. Further, the pulsating flow from the pump develops additional high stress loads throughout the system due to the differing elastic deformation of the rods and the pumped fluid, itself. As proven time after time, the combined acceleration shocks, elastic forces, etc., caused by the intermittent flow from a reciprocating pump are usually highly detrimental to the pumping systems and normally lead to early failure, e.g., sucker-rod failure, pump failure, etc., and increased maintenance costs and downtime.

One general solution that has been proposed for alleviating many of the problems normally associated with pressure pulsations and/or acceleration shocks inherently present in a reciprocating pump system involves providing some means in the system to smooth out or dampen the pressure pulses in the pumped flow. A variety of such dampening means have been proposed, all of which appear to have merit. For example, a wide variety of fluid accumulators and/or pulsation dampeners have been positioned in the path of pumped fluid at the surface after the fluid has been pumped from the well; see U.S. Pat. Nos. 2,764,103; 3,198,133: and 4,445,829 and U.K. Patent Application GB No. 2,054,041A.

Other proposed solutions have included (1) using hollow sucker rods as a downhole surge chamber, e.g., U.S. Pat. No. 3,272,145, (2) providing a surge chamber on a solid sucker rod, e.g., U.S. Pat. No. 1,235,112, or (3) providing surge chambers on the production tubing, e.g., U.S. Pat. No. 2,215,558. More recently, it has been proposed to position an inflated bladder in a chamber on the production tubing wherein the fluid from the downhole pump acts against the bladder to thereby dampen the pressure surges in the pumped fluid, e.g., U.S. Pat. No. 4,628,994.

While each of the known pulsation dampeners appear to be sound in theory, for whatever reason, none appear to have ever found widespread commercial application in the industry. That is, as best as can be determined, the tremendous number of wells using reciprocating pumps today (estimated to be well over one-half million in the United States alone) still experience the problems due to the pressure pulsations and shocks inherent in the intermittent flow from a reciprocating pump and still experience early sucker rod failure, high pump maintenance, high horsepower requirements, etc. Therefore, it can be readily seen that a need still exists for a pratical pulsation dampener that can be economically produced and easily installed into new and/or existing reciprocating pumping systems which will effectively reduce the pressure pulsations and/or acceleration shocks in the pumped fluid.

DISCLOSURE OF THE INVENTION

The present invention provides a downhole, reciprocating pump system including a pulsation dampener for dampening pressure pulsation and/or acceleration shocks in the fluid being pumped from a well by the reciprocating pump. The pulsation dampener is connected to or positioned at the lower end of a string of production tubing in the well just above a downhole, reciprocating pump which, in turn, is operated by a string of sucker rods which extend to the surface. The pulsation dampener is relatively simple in construction which allows it to be produced economically and easily installed into new or existing downhole pump systems to substantially reduce the problems associated with the intermittent flow from reciprocating pumps.

More particularly, the preferred embodiment of the present downhole, reciprocating pump system includes a pulsation dampener that is comprised of a conduit, e.g., pup joint of production tubing, which has at least one radial opening, preferably a plurality of openings, therethrough intermediate its ends. An elastic sleeve is tightly fitted over the conduit to cover and seal the radial openings when the sleeve is in its relaxed position and is affixed at each of its ends to the conduit. A housing is positioned around the sleeve and is affixed at each of its ends to the conduit to thereby form an annulus between the relaxed sleeve and the housing.

A one-way valve is positioned in a passage into the housing through which the annulus can be precharged with gas under pressure. The volume of the annulus is approximately twice that of the volume of fluid which will be pumped by a single pump stroke of the downhole reciprocating pump and precharged gas pressure in the annulus is approximately equal to the pressure exerted by the head of well fluid at the downhole location of the dampener in the well. The upper end of the conduit of the dampener is connected to the lower end of the production tubing and the barrel of the reciprocating pump is connected to or is positioned at the lower end of the conduit. The plunger of the pump is positioned for reciprocating movement in the barrel and is operated by a string of sucker rods which extend to the surface.

At the start of each up or pump stroke of the pump, the fluid flows through the openings in the dampener to expand the sleeve against the pressure in the annulus to dampen the pressure pulsations and/or shocks due to the sudden acceleration of the fluid head above the pump. At the conclusion of the pump stroke and during the down stroke of the pump, the sleeve relaxes to its original position thereby forcing the fluid back through the openings and into the flow stream up the production tubing.

In addition to substantially reducing the detrimental effects associated with pressure pulses and shocks which are inherently present in reciprocating pump system, actual field tests have shown that the present pulsation dampener also provides substantial improvements over identical downhole reciprocating pump systems in actual use today which do not include the present dampener, some of which are as follows: (1) Both the maximum and minimum peak polish rod loads are significantly reduced thereby substantially extending the expected life of the sucker rods; (2) the polished rod horsepower is reduced allowing a smaller and more economically-operated power means to be used to operate the same downhole pump; (3) the maximum net torque on the system is reduced; and (4) the daily operating and maintenance costs are reduced.

BRIEF DESCRIPTION OF THE DRAWINGS

The actual construction, operation, and apparent advantages of this invention will be better understood by referring to the drawings in which like numerals identify like parts and in which.

DESCRIPTION OF THE PREFERRED EMBODIMENTS

Figure 1:
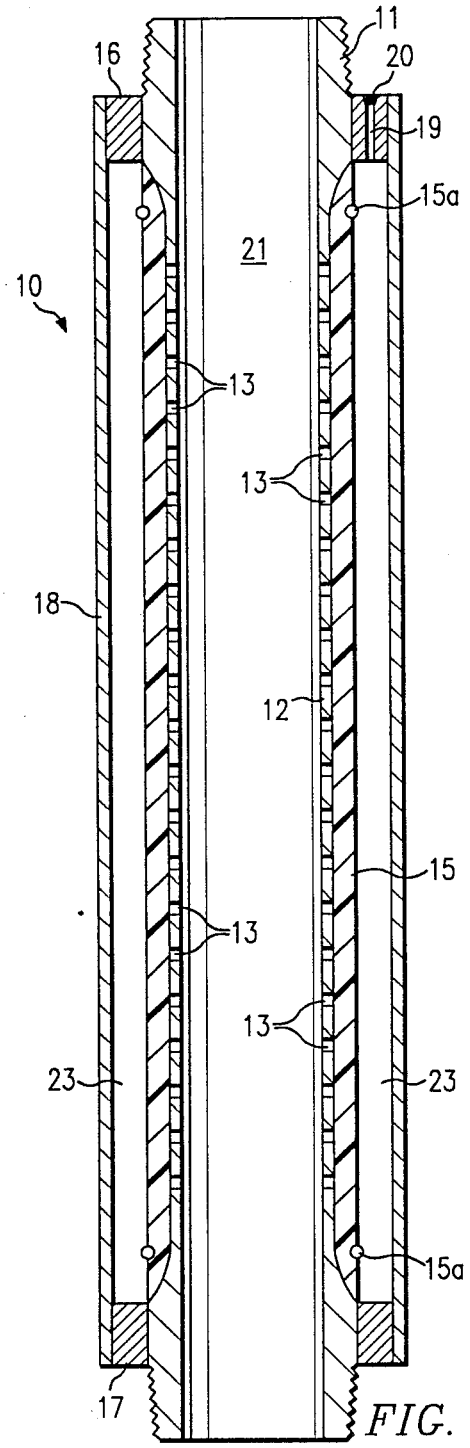
FIG. 1 is a sectional view of the preferred embodiment of the pulsation dampener of the present invention with its elastic sleeve in a normal, relaxed position.
Figure 2:
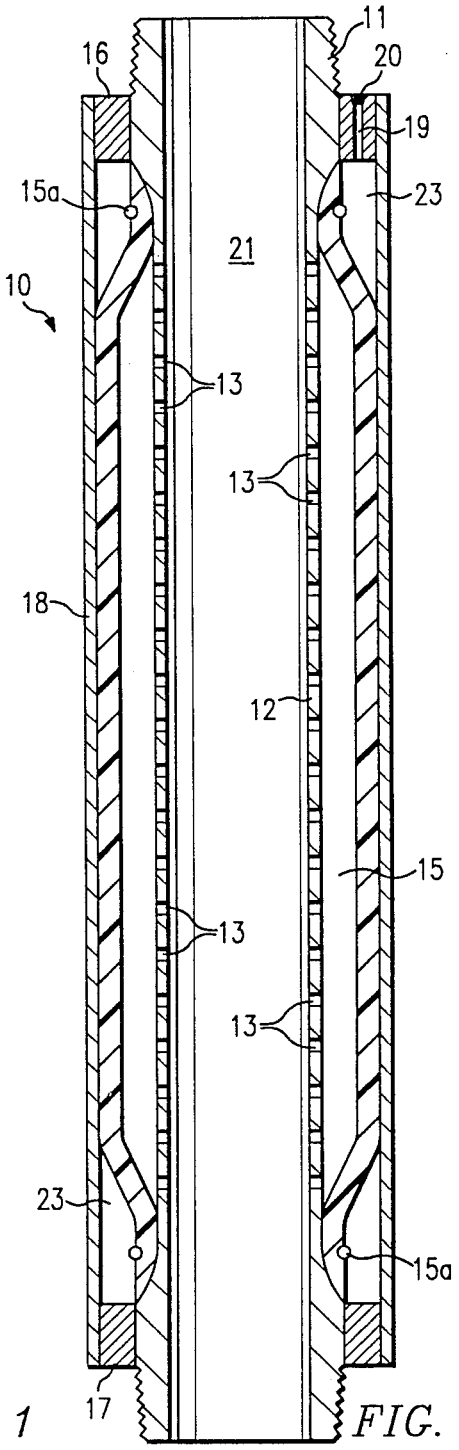
FIG. 2 is a sectional view of the dampener of FIG. 1 with the elastic sleeve in an expanded position.

Referring more particularly to the drawings, FIGS. 1 and 2 disclose the preferred embodiment of the downhole pulsation dampener 10 of the present invention. Dampener is comprised of a central conduit 11 which is preferably comprised of a length of the same tubing as that used to form the string of production tubing in the well in which dampener 10 is to be used. For example, a "pup joint" of tubing (e.g., commercially-available lengths of tubing shorter than a standard length) of the appropriate size is selected and the intermediate portion 12 thereof is perforated to provide one or more radial openings 13 therethrough (only some of which are numbered in the drawings for the sake of clarity).

An elastic sleeve 15, e.g., rubber, is tightly fitted onto conduit 11 and extends completely across intermediate section 12 to cover and seal all of openings 13. Sleeve 15 is secured at each of its ends to conduit 11 by wire-wrap 15*a*, bonding, claims, or the like. Upper and lower collars 16, 17, respectively, are welded or otherwise secured to conduit 11 adjacent the ends of sleeve 15. Cylindrical housing 18 extends between collars 16, 17 and is secured thereto by welding or the like. Collar 16 has a passage 19 therethrough having a gas inlet, one-way valve 20 therein through which annulus 23 formed between sleeve 15 and housing 18 can be charged with gas (e.g., nitrogen).

From the above description, it can be seen that when the pressure of any fluid flowing through bore 21 of conduit 11 exceeds the pressure of the gas in annulus 23 of dampener 10, the fluid will flow through openings 13 to act on sleeve 15 to expand into annulus 23 (FIG. 2) to compress the gas in the annulus. When the pressure of the fluid in bore 21 drops below the pressure in annulus 23, this difference in pressure and the resiliency of sleeve 15 returns it to its relaxed position (FIG. 1) thereby forcing the fluid in sleeve 15 back through openings 13 into bore 21. Now that the basic structure of dampener 10 has been set forth, a preferred downhole reciprocating pump system 22 will be described into which dampener 10 is incorporated to substantially alleviate the pressure pulsations and/or acceleration shocks in the system.

Referring now to FIGS. 3–6, conduit 11 of dampener 10 is threaded at both ends and is positioned at and connected to one end to the lower end of production tubing string 24 which, in turn, extends to the surface of the well being produced. Pump barrel 26 of reciprocating pump 25 is positioned at and/or is connected to the lower end of conduit 11 and has a standing valve 27 therein. Plunger 28 of pump 25 having a traveling valve 29 therein is reciprocated up and down with barrel 26 by a string 30 of sucker rods which extend to the surface and are connected to the "horsehead" 31 of a pump jack or the like (not shown) as will be understood in the art. Annulus 23 of damper 10 has been precharged with gas, e.g., nitrogen, through one-way valve 21 to a pressure approximately equal to the static pressure of the fluid head in conduit 11 when system 22 is in an operable position within a well. The operation of downhole reciprocating pump system 22 is as follows.

Figures 3, 4, 5, 6:
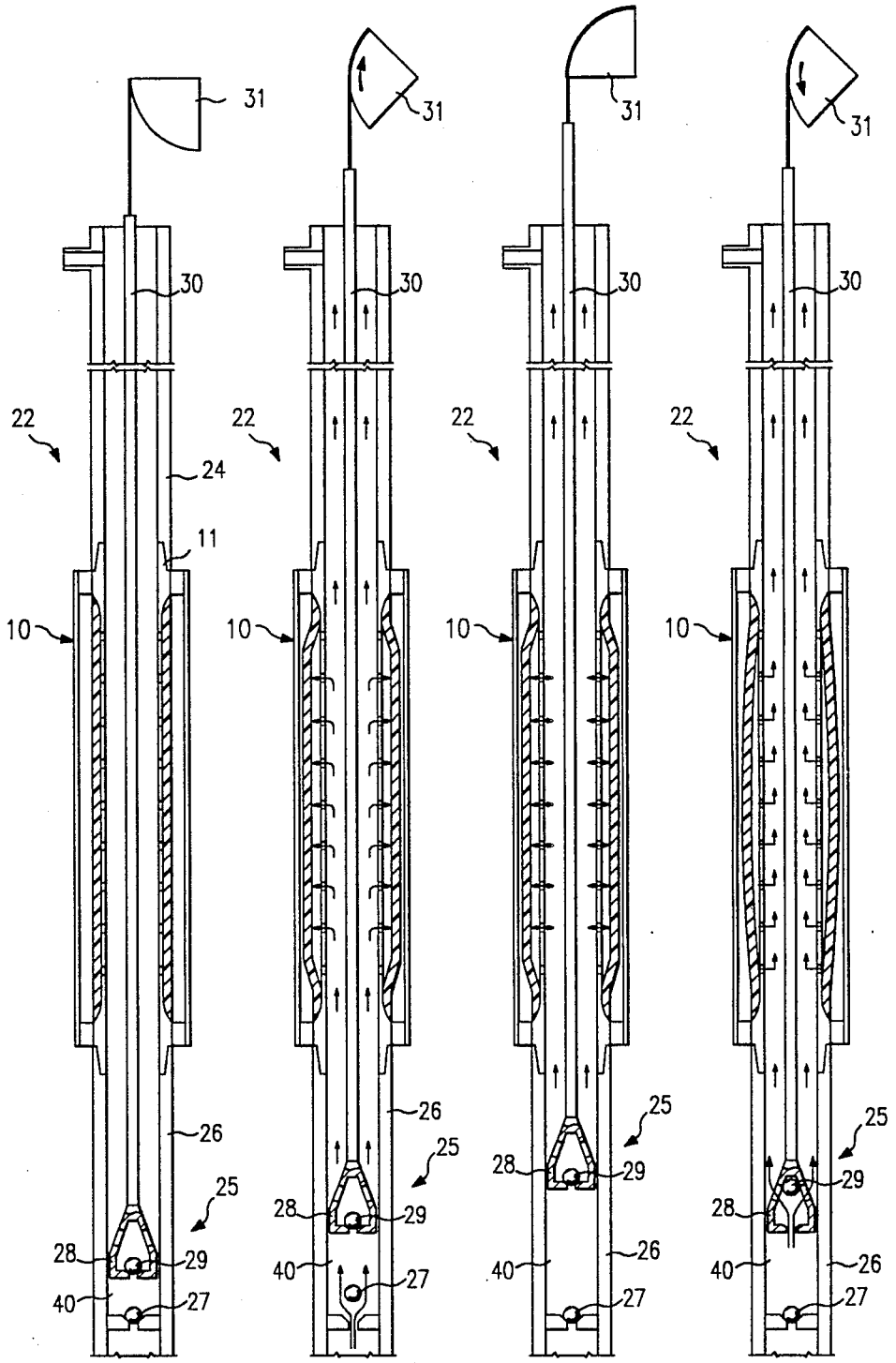
FIG. 3 is a sectional view of a downhole reciprocating pump system having the dampener of FIG. 1 incorporated therein and having the plunger of the pump in a start or bottom dead center position.
FIG. 4 is a sectional view of the downhole reciprocating pump system of FIG. 3 showing the pump plunger on an up or pumping stroke.
FIG. 5 is a sectional view of the downhole reciprocating pump system of FIG. 4 with the pump plunger at top dead center.
FIG. 6 is a sectional view of the downhole reciprocating pump showing the pump plunger during a down stroke.

Referring first to FIG. 3, plunger 28 is in its bottom dead position within barrel 26 and the head of fluid in conduit 11 of dampener 10 and in production tubing 24 is at rest. As sucker rods 30 begin to move plunger 28 through an up or pump stroke FIG. 4 , the space 40 between standing value 27 and traveling valve 29 increases and the pressure therein decreases. This allows the well fluid below the pump barrel 26 to lift standing valve 27 from its seat and flow into barrel 26. At the same time, the fluid head pressure on the top of the traveling valve 29 keeps valve 29 seated in plunger 28 so that the column of fluid above the plunger 28 is raised or pumped up tubing 24 during the up stroke of the pump.

It will be understood that as pump 25 begins its upward stroke, a sudden impulse is imparted to the fluid above the plunger as the fluid is accelerated to its ultimate during the up stroke. This acceleration shock, the elasticity of rods 30 and the fluid, itself, and other factors inherent in reciprocating pump system can generate highly detrimental or destructive forces that can lead to serious damage if not compensated for. In the present invention, as plunger 28 begins its up stroke (FIG. 4), the sudden shock or increase in pressure of the fluid just above plunger 28 exceeds the precharged pressure in annulus 23 of dampener 10 so flow will occur through openings 13 and will act on sleeve 15 to expand same thereby increasing the pressure in annulus 23. The sudden pulsation caused by the acceleration of the fluid during the start of the up stroke is accordingly "absorbed" or attenuated by the compliance of dampener 10.

As plunger 28 reaches top dead center (FIG. 5), the suction in space 40 ceases and standing valve 27 drops back onto its seat. The pressures in conduit 11 and annulus 22 will theoretically be equal with sleeve 15 in its fully expanded position. After an instantaneous pause, plunger 28 begins to move downward (FIG. 6), fluid in space 40 is unable to flow through closed standing valve 27 and, instead, is put under compression to thereby lift traveling valve 29 from its seat to allow fluid to flow from space 40 in barrel 26 into conduit 11 above the plunger. At this time, the pressure in conduit 11 is reduced thereby allowing the elevated pressure in annulus 23 and the resiliency of sleeve 15 to return sleeve 15 to its relaxed position. This forces fluid back through openings 13 and into conduit 11 to maintain movement of the fluid in tubing 24 during the down stroke of pump 25, thereby effectively smoothing out the pulsations and shocks in the pumped fluid flow and substantially reducing the load on the system at the start of the next up stroke of the pump.

The above description of the operation of system 22 is based on the theoretical analysis of the downhole pump system. However, in actual well tests of the present invention, downhole sensors indicate that the acceleration shock and/or pressure pulsations in the fluid column or head are actually dampened by pulsation dampener 10 during only a short travel of plunger 28 during the start of the up stroke and that sleeve 15 has expanded and relaxed before plunger 28 has reached top dead center. Regardless of the actual operational sequence of dampener 10, as will be seen from the following table summarizing the results from an actual well test, dampener 10 does function to alleviate the severe problems associated with pressure pulsations and/or shocks in downhole reciprocating pump systems and substantially increases the overall efficiencies of such systems.

PULSATION DAMPENER TEST RESULTS

| SURFACE ANALYSIS | WITHOUT DAMPENER | | WITH DAMPENER | |
|---|---|---|---|---|
| Stroke Length (ins.) | 146.4 | | 147.2 | |
| Pump Strokes/minute | 10.66 | | 10.64 | |
| Pump Plunger Diameter (ins.) | 3.25 | | 3.25 | |
| Depth of Pump in Well (ft.) | 1220 | | 1220 | |
| Specific Gravity of fluid | 1.0 | | 1.0 | |
| Rod Weight in fluid (lbs.) | 1724 | | 1724 | |
| Peak Polish Rod Load (lbs.) | 9731 | | 7362 | |
| Minimum Polish Rod Load (lbs.) | 978 | | 348 | |
| Structure Loading (%) | 81.8 | | 61.9 | |
| Polish Rod Horsepower | 19.4 | | 15.9 | |
| % of Sucker Rod Loading | 103.4 | | 79.9 | |
| Electricity Costs ($/bbl.) | 3.85 | | 3.17 | |
| | *(1) | **(2) | *(1) | **(2) |
| Cyclic Load Factor | 1.37 | 1.47 | 1.37 | 1.30 |
| Recommended Motor Size (H.P.) | 35.0 | 37.0 | 30.0 | 28.0 |
| Daily Power Used (KwH) | 385 | 415 | 317 | 300 |
| Max Counterbalance Moment | 380.5 | 499.7 | 328.8 | 395.7 |
| Counterbalance Effect @ 90° (lbs.) | 3928 | 5663 | 3187 | 4156 |
| Counterbalance Effect @ 270° (lbs.) | 3575 | 5199 | 2881 | 3788 |
| Max Net Torque (in.-lbs.) | 404.5 | 322.3 | 280.7 | 220.3 |
| % Gear Reducer Rating | 177.4 | 141.4 | 123.1 | 96.6 |
| DOWNHOLE ANALYSIS | | | | |
| Pump Intake Pressure (psi) | 163 | | 153 | |
| Fluid Load (lbs.) | 3028 | | 3111 | |
| Fluid Level from Surface (ft.) | 843 | | 866 | |
| Fluid Level above Pump (ft.) | 377 | | 354 | |
| Pump Efficiency (%) | 74.8 | | 75.3 | |

*(1) Pumping Unit Unbalanced
**(2) Pumping Unit Balanced

It should be recognized that the actual dimensions of dampener will vary with the actual situation involved but roughly the volume of annulus 23 in dampener 10 should be approximately twice the volume of fluid pumped on each pump stroke of pump 25. The required annulus volume may be provided in a single dampener or may be provided by coupling several dampeners together. By way of example only, the following dimensions are those for the dampeners 10 used in the test set forth in the above table wherein two dampeners were coupled together.

Conduit 11 was a 12 foot length of regular $2\frac{7}{8}$ inch tubing. Housing 18 is an 11 foot - 6 inch length of $4\frac{3}{4}$ inch I.D., 5 inch O.D. tubular which is welded to collars 16, 17 to form annulus 23 having a volume of approximately 1300 cubic inches. The intermediate section of conduit 11 was perforated with 12 rows of $\frac{3}{8}$" diameter holes 13, radially spaced at 30° intervals, starting 11 inches from either end of conduit 11, producing 1470 holes or 160 sq. inches of opening (15% of total surface area) between bore 21 and annulus 23. Sleeve 15 was an ⅛ inch thick, reinforced rubber sleeve having a good resistance to hydrocarbons and hydrogen sulfide and a low permeability to gas, e.g., nitrogen, which was used to precharge annulus 23 to 455 psi, this being equal to the static fluid head pressure of 519 psi when adjusted for the temperature difference between surface and pump depth. Of course, the material for sleeve 15 should be selected for the particular conditions which it will encounter during operation to insure it will not be adversely affected by certain components in the fluid being pumped.

What is claimed is:

1. A downhole, reciprocating pump system for pumping fluids from a well, said system comprising:

a string of production tubing in said well;

a pulsation dampener comprising;

a conduit having an upper end and a lower end, said upper end attached to the lower end of said production tubing, said conduit having at least one radial opening therethrough intermediate said upper and lower ends;

an elastic sleeve fitted on said conduit and completely sealing said at least one opening when in a relaxed position, said elastic sleeve having an interior in communication with said at least one opening and also having an exterior;

a housing defining an enclosure sealingly affixed to said conduit and spaced therefrom to thereby form an annulus between the exterior of said sleeve and housing;

a port extending through said enclosure;

valve means in said port for allowing the introduction into said annulus of a gas under pressure to apply a selected pressure to the exterior of said sleeve, and for preventing said gas under pressure from flowing out of said port to enable pre-charging of said annulus prior to installation of said pump system in said well;

a reciprocating pump comprising:

a pump barrel positioned at said lower end of said conduit; and a pump plunger positioned for reciprocating movement in said pump barrel; and a sucker rod string attached to said plunger for moving said plunger in said pump barrel whereby at least some of the pumped fluid will flow through said at least one opening in said conduit to expand said sleeve into said annulus during the pump stroke of said pump and will flow back through said at least one opening into said conduit when the pressure in said annulus exceeds the pressure in said conduit thereby dampening pressure pulsations and/or acceleration shock in the pumped fluid flow.

2. The downhole, reciprocating pump system of claim 1 wherein said at least one opening comprises:

a plurality of spaced radial openings.

3. The downhole reciprocating pump system of claim 2 wherein said elastic sleeve is affixed at its ends to said conduit.

4. The downhole reciprocating pump system of claim 3 wherein the volume of said annulus is equal approximately to the volume of fluid pumped by said pump on a single pump stroke.

5. The downhole reciprocating pump system of claim 4 wherein:

said selected pressure in said annulus is equal to the pressure of the static fluid head in said well.

6. The downhole, reciprocating pump system of claim 5 wherein said gas comprises nitrogen.

7. The downhole, reciprocating pump system of claim 3 including:

a second pulsation dampener connected between said upper end of said conduit and said lower end of said string of production tubing.

8. A pulsation dampener for dampening pressure pulsations and/or acceleration shocks in the fluid pumped from a well by a downhole, reciprocating pump, said dampener comprising:

a conduit having one end adapted to be connected at the lower end of a production tubing in a well and having its other end adapted to be positioned adjacent the upper end of a barrel of a downhole reciprocating pump, said conduit having at least one radial opening therethrough intermediate said ends;

an elastic sleeve fitted over said conduit and completely covering and sealing said at least one opening when in a relaxed position, said elastic sleeve having an interior in communication with said at least one opening and also having an exterior;

a pair of collars sealingly affixed to said conduit and axially spaced apart with one located above said sleeve and one spaced below said sleeve;

a housing sealingly affixed to said collars and surrounding said sleeve and spaced therefrom to form an annulus between said sleeve and said housing;

a port extending through one of said collars; and valve means in said port for allowing the introduction into said annulus a gas under pressure to apply a selected pressure to the exterior of said sleeve, and for preventing said gas from flowing out of said port to enable precharging of said annulus prior to installation of said pulsation dampener in said well.

9. The pulsation dampener of claim 8 wherein said annulus has a volume approximately equal to the volume of fluid to be pumped by a single pump stroke of a reciprocating pump with which said dampener is to be used.

10. The pulsation dampener of claim 9 wherein said at least one opening comprises:

a plurality of spaced radial openings.

11. The pulsation dampener of claim 10 including:

means for attaching each end of said sleeve to said conduit.

12. The pulsation dampener of claim 11 wherein said means for charging said annulus with gas comprises:

a passage through said housing; and a one-way valve in said passage.

* * * * *